US008342714B1

(12) United States Patent
Rea et al.

(10) Patent No.: US 8,342,714 B1
(45) Date of Patent: Jan. 1, 2013

(54) MOBILE LIGHTING APPARATUS

(75) Inventors: Gerald W. Rea, Scottsburg, IN (US); Robert A. Drake, Nashville, IN (US)

(73) Assignee: Stray Light Optical Technologies, Scottsburg, IN (US)

( * ) Notice: Subject to any disclaimer, the term of this patent is extended or adjusted under 35 U.S.C. 154(b) by 436 days.

(21) Appl. No.: 12/775,030

(22) Filed: May 6, 2010

Related U.S. Application Data

(63) Continuation of application No. 61/176,103, filed on May 6, 2009.

(51) Int. Cl.
*F21V 29/00* (2006.01)

(52) U.S. Cl. ..... 362/264; 362/265; 362/294; 362/373

(58) Field of Classification Search ..... 362/218, 362/264, 265, 294, 373
See application file for complete search history.

(56) References Cited

U.S. PATENT DOCUMENTS

| | | | |
|---|---|---|---|
| 4,167,783 | A | 9/1979 | Mitchell |
| 4,220,981 | A | 9/1980 | Koether |
| 4,392,187 | A | 7/1983 | Bornhorst |
| 4,712,167 | A | 12/1987 | Gordin et al. |
| 5,207,747 | A | 5/1993 | Gordin et al. |
| 5,225,765 | A | 7/1993 | Callahan et al. |
| 6,737,809 | B2 | 5/2004 | Espiau et al. |
| 6,922,021 | B2 | 7/2005 | Espiau et al. |
| 7,348,732 | B2 | 3/2008 | Espiau et al. |
| 7,358,678 | B2 | 4/2008 | Espiau et al. |
| 7,362,054 | B2 | 4/2008 | Espiau et al. |
| 7,362,055 | B2 | 4/2008 | Espiau et al. |
| 7,362,056 | B2 | 4/2008 | Espiau et al. |
| 7,372,209 | B2 | 5/2008 | Espiau et al. |
| 7,391,158 | B2 | 6/2008 | Espiau et al. |
| 7,429,818 | B2 | 9/2008 | Chang et al. |
| 7,498,747 | B2 | 3/2009 | Espiau et al. |
| 7,518,315 | B2 | 4/2009 | Espiau et al. |
| 7,525,253 | B2 | 4/2009 | Espiau et al. |
| 7,629,570 | B2 * | 12/2009 | Mondloch et al. ..... 250/227.11 |
| 7,638,951 | B2 | 12/2009 | DeVincentis et al. |
| 7,701,143 | B2 | 4/2010 | DeVincentis |
| 7,719,195 | B2 | 5/2010 | DeVincentis et al. |
| 7,722,227 | B2 * | 5/2010 | Zhang et al. ..... 362/294 |
| 7,791,278 | B2 | 9/2010 | DeVincentis et al. |
| 7,791,280 | B2 | 9/2010 | DeVincentis et al. |
| 2005/0134188 | A1 | 6/2005 | Lindqvist |
| 2006/0250090 | A9 | 11/2006 | Guthrie et al. |
| 2007/0211990 | A1 | 9/2007 | Espiau et al. |
| 2007/0211991 | A1 | 9/2007 | Espiat et al. |
| 2007/0217732 | A1 | 9/2007 | Chang et al. |
| 2007/0236119 | A1 | 10/2007 | Espiau |
| 2007/0241688 | A1 | 10/2007 | DeVincentis et al. |
| 2008/0054813 | A1 | 3/2008 | Espiau et al. |
| 2008/0203922 | A1 | 8/2008 | Guthrie et al. |
| 2008/0211971 | A1 | 9/2008 | Pradhan |

(Continued)

*Primary Examiner* — Stephen F Husar
(74) *Attorney, Agent, or Firm* — Faegre Baker & Daniels LLP

(57) ABSTRACT

A lighting apparatus includes a housing, a light emitter located in an interior region of the housing, a driver for the emitter, and a heat sink coupled to the driver. The heat sink includes a plurality of fins for cooling the driver. The apparatus further includes a driver mounting portion having a mounting surface and a side wall. The side wall is coupled to one of the heat sink and the driver so that the plurality of fins of the heat sink are exposed. The mounting surface of the driver mounting portion is coupled to the housing.

20 Claims, 17 Drawing Sheets

U.S. PATENT DOCUMENTS

2008/0258627 A1 10/2008 DeVincentis et al.
2009/0026911 A1 1/2009 Hafidi et al.
2009/0026975 A1 1/2009 Ralston et al.
2009/0073700 A1* 3/2009 Cruickshank ..... 362/373
2009/0146543 A1 6/2009 Chang et al.
2009/0167201 A1 7/2009 Duelli et al.
2009/0243488 A1 10/2009 Espiau et al.
2009/0284166 A1 11/2009 DeVincentis et al.
2010/0097808 A1 4/2010 Jurik
2010/0102724 A1 4/2010 Gilliard et al.
2010/0123396 A1 5/2010 DeVincentis et al.
2010/0123407 A1 5/2010 Duelli
2010/0148669 A1 6/2010 DeVincentis et al.
2010/0156301 A1 6/2010 Hollingsworth et al.
2010/0156310 A1 6/2010 Hollingsworth et al.
2010/0165306 A1 7/2010 McGettigan et al.
2010/0171436 A1 7/2010 DeVincentis et al.
2010/0253231 A1 10/2010 DeVincentis et al.

* cited by examiner

MOBILE LIGHTING APPARATUS

CROSS REFERENCE TO RELATED APPLICATION

This application claims the benefit of U.S. Provisional Application Ser. No. 61/176,103, filed on May 6, 2009, which is expressly incorporated by reference.

BACKGROUND AND SUMMARY

The present disclosure relates to a lighting apparatus. More particularly, the present disclosure relates to an energy efficient lighting apparatus having a compact design and effective heat management characteristics.

In an illustrated embodiment of the present disclosure, a lighting apparatus includes a housing having a rear wall, first and second side panels, a top wall, a bottom wall and a front window cooperating to define an interior region of the housing. The apparatus also includes a light emitter located in the interior region of the housing, a driver for the emitter, and a heat sink coupled to the driver. The heat sink includes a plurality of fins for cooling the driver. The apparatus further includes a driver mounting portion having a mounting surface and a side wall. The side wall is coupled to one of the heat sink and the driver so that the plurality of fins of the heat sink are exposed. The mounting surface of the driver mounting portion is coupled to the housing, preferably to the rear wall.

In one illustrated embodiment of the present disclosure, the light emitter includes a body portion and a bulb located on a front side of the body portion. Illustratively, the light emitter includes a plasma bulb located within a dielectric material, and the driver generates a radio frequency (RF) signal which is guided to the emitter by a cable so that the RF signal vaporizes contents of the bulb into a plasma state to generate a source of light. The driver is spaced apart from the mounting surface of the driver mounting portion to provide an air gap to reduce heat transfer from the housing containing the light emitter to the driver. The heat sink is configured to maintain a temperature of the driver at less than or equal to 75° C. despite the proximity of the driver to the housing containing the light emitter.

Additional features and advantages of the present system will become apparent to those skilled in the art upon consideration of the following detailed description of illustrative embodiments exemplifying the best mode of carrying out the present system as presently perceived.

BRIEF DESCRIPTION OF THE DRAWINGS

The detailed description particularly refers to the accompanying figures in which.

DETAILED DESCRIPTION OF THE DRAWINGS

Figure 1:
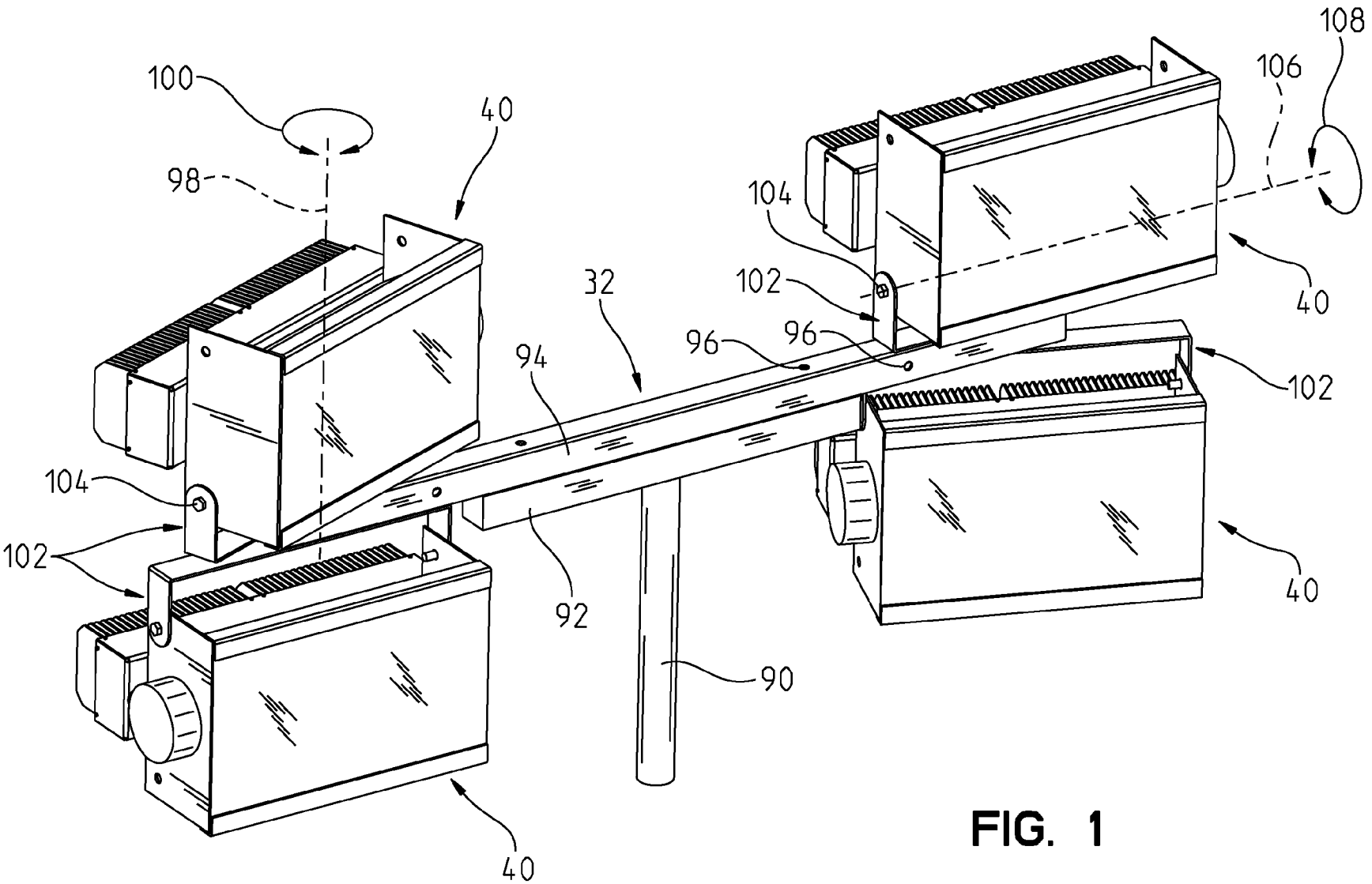
FIG. 1 is a perspective view illustrating an exemplary embodiment of an array of lights mounted on a T-bar of the light tower.
Figure 2:
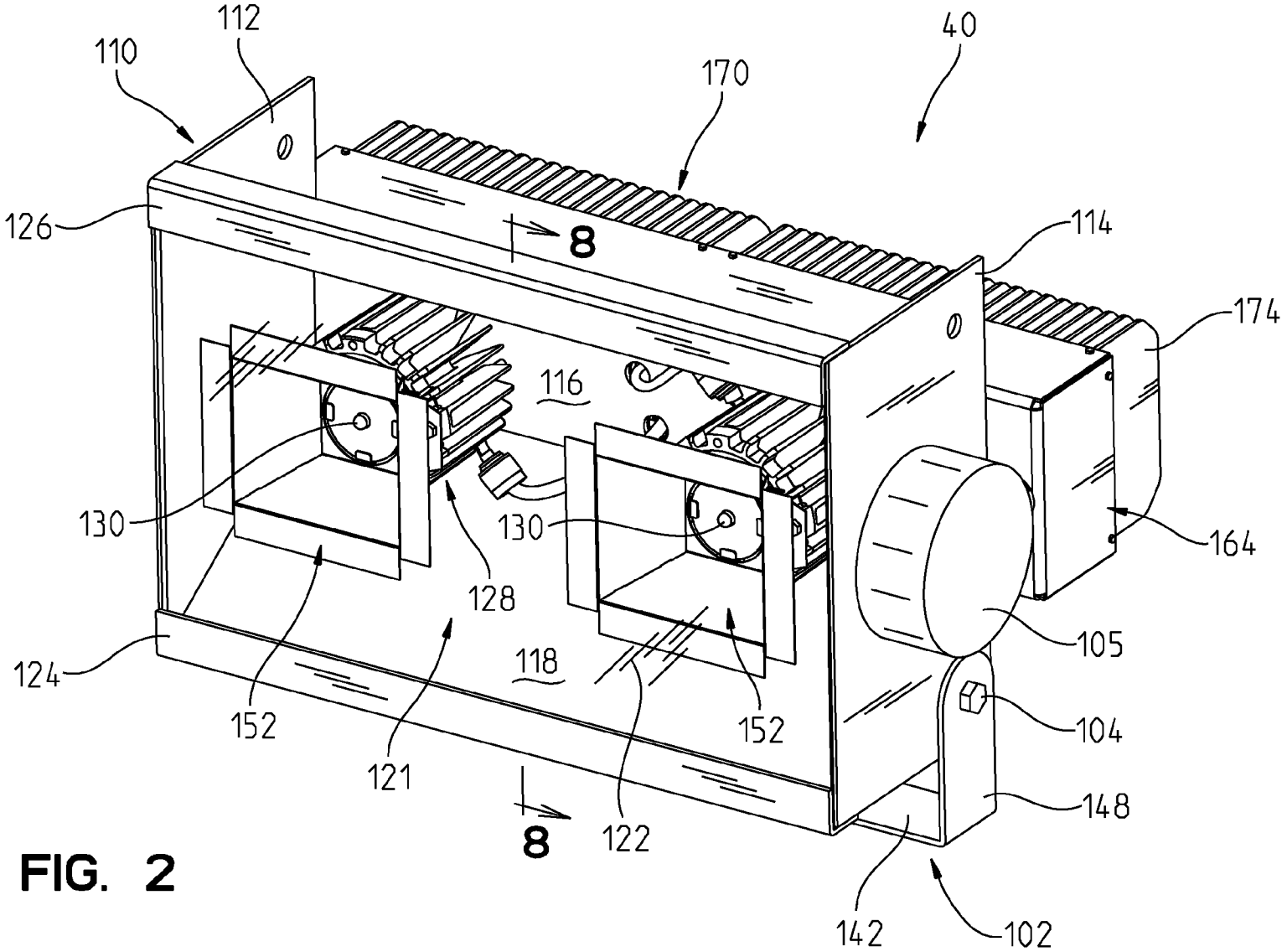
FIG. 2 is a perspective view of one of the energy efficient lights of FIG. 1.
Figure 3:
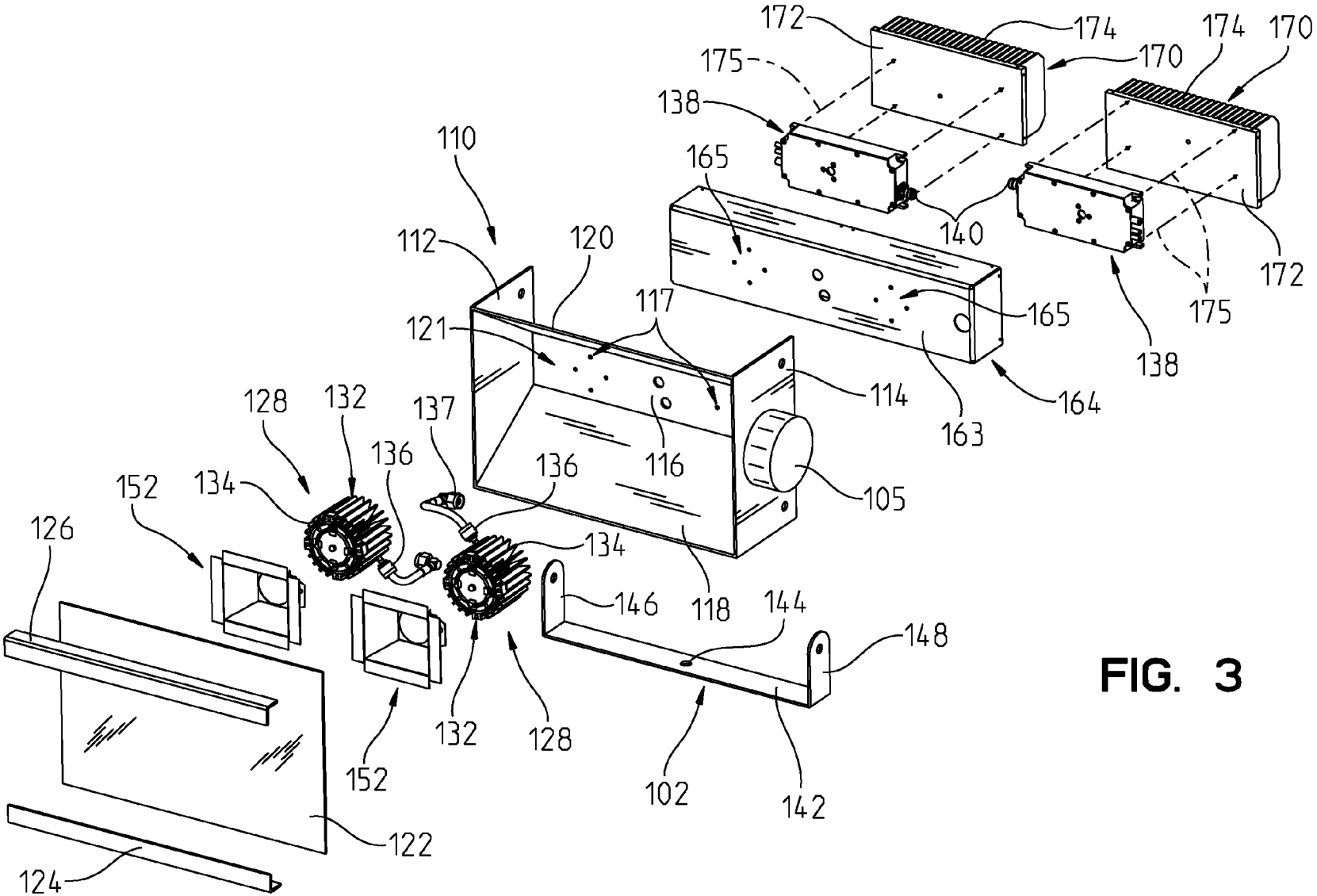
FIG. 3 is an exploded perspective view of the light of FIG. 2.

For the purposes of promoting an understanding of the principles of the present disclosure, reference will now be made to the embodiments illustrated in the drawings, which are described below. The embodiments disclosed below are not intended to be exhaustive or limit the present system to the precise form disclosed in the following detailed description. Rather, the embodiments are chosen and described so that others skilled in the art may utilize their teachings. Therefore, no limitation of the scope of the claimed present system is thereby intended. The present system includes any alterations and further modifications of the illustrated devices, systems and described methods and further applications of the principles of the present disclosure which would normally occur to one skilled in the art. Corresponding reference characters indicate corresponding parts throughout the several views.

Details of an illustrative embodiment of the energy efficient lights 40 are illustrated in FIGS. 1-11. In the illustrative embodiment, four of the lights 40 are mounted to a T-bar 32 which is used to mount the lights to a support structure or light tower. More or less lights 40 may be used, if desired. As shown in FIG. 1, T-bar 32 includes a cylindrical mounting portion 90 and a transverse support member 92 coupled to the cylindrical portion 90. A mounting bar 94 is coupled to support portion 92. Mounting bar 94 includes a plurality of spaced apertures 96 to permit mounting of the lights 40 at different locations thereon. In an illustrative embodiment, the lights 40 may be rotated about a mounting axis 98 as illustrated by double-headed arrow 100 in FIG. 1. Each of the lights 40 is independently adjustable. In one illustrated embodiment, the lights 40 are manually adjustable. In another embodiment, lights 40 are automatically adjustable through the use of suitable controls and motors (not shown). In an illustrated embodiment, the lights 40 are pivotable about axis 100 by 180° in either direction.

As shown in FIG. 1, the lights 40 are coupled to the mounting member 94 by a generally U-shaped mounting bracket 102. Lights 40 are coupled to the mounting brackets 102 by fasteners 104 so that the lights 40 are pivotable about an axis 106 as shown by double-headed arrow 108. Therefore, the lights are adjustable to pivot upwardly or downwardly about axis 106 as needed. In normal operation, the lights 40 are typically aimed slightly downwardly. A cylindrical knob or handle 105 may be gripped by an operator to facilitate adjustment of the position of the light 40.

Additional details of the lights 40 are illustrated in FIGS. 2-11. Each light 40 includes a housing 110 having first and second side panels 112 and 114, a rear wall 116, a bottom wall 118 and a top wall 120 defining an interior region 121 of the housing 110. A window 122 is coupled to the housing 110 by connector strips 124 and 126. Window 122 is made of glass or other suitable material which allows light to pass therethrough.

In an illustrated embodiment, a pair of light emitters 128 are located within the housing 110 as best shown in FIGS. 2, 3 and 8-10, for example. In other embodiments, a single emitter 128 is used. Each of the emitters 128 is illustratively a model number STA 40-02 light emitting plasma emitter available from Luxim® located in Sunnyvale, Calif. The emitters 128 illustratively include a bulb 130 located within a dielectric material in a puck. The puck is mounted within a body portion 132 having a plurality of heat sinking fins 134 formed thereon. A coaxial cable connector 136 is coupled to the body 132. Each coaxial connector 136 is coupled to a radio frequency (RF) driver 138 by a coaxial cable 137 also coupled to a coaxial connector 140 on the driver 138. The drivers 138 generate a radio frequency (RF) signal which is guided through the coaxial cables 137 and the puck into an energy field around the bulb 130. The high concentration of energy in the electric field vaporizes contents of the bulb 130 into a plasma state at the center of bulb 130 to generate an intense source of light.

As discussed above, a U-shaped mounting bracket 102 includes a central mounting portion 142 having an aperture 144 configured to receive a fastener to secure the mounting bracket 102 to the mounting bar 94 as discussed above with reference to FIG. 1 above. The mounting bracket 102 further includes first and second end portions 146 and 148 which are coupled to the first and second side panels 112 and 114, respectively, of housing 110 by suitable fasteners 104.

A pair of reflectors 152 are also located within housing 110. A reflector 152 is coupled to each emitter 128 as best illustrated in FIG. 9. The body portion 132 of each emitter 128 includes threaded apertures 154 configured to receive fasteners 156. The fasteners 156 extend through apertures 158 formed in a flange 160 of reflector 152. An outer flange 162 of reflector 152 is located at or near the window 122 as shown in FIG. 8.

A driver mounting portion 164 has a mounting surface 163 which is coupled to the rear wall 116 of housing 110. Emitters 128 are mounted within housing 110 by fasteners 166 best shown in FIG. 10. Fasteners 166 extend through apertures 165 formed in the surface 163 of driver mounting portion 164, through apertures 117 in rear wall 116 and into threaded openings 168 formed in body portions 132 of emitters 128. FIG. 8 illustrates that the fasteners 116 secure the emitters 128 within the housing 110 by drawing the body portion 132 into the V-shaped section formed by walls 118 and 120 in the direction of arrow 169. An air gap 185 is provided between rear surface 173 of body portion 132 and rear wall 116.

Figure 8:
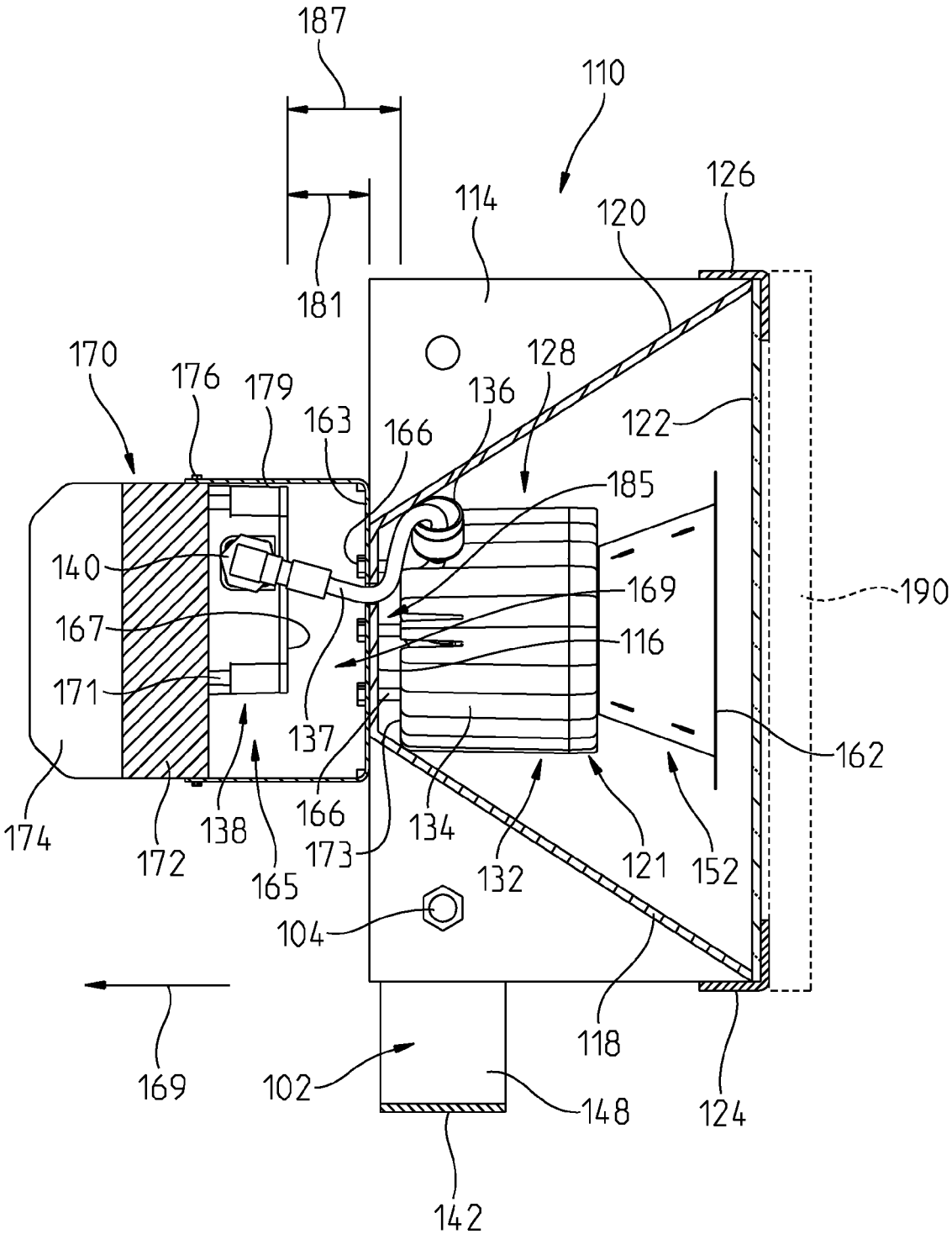
FIG. 8 is a sectional view taken along lines 8-8 of FIG. 2 illustrating additional details of the light.
Figure 9:
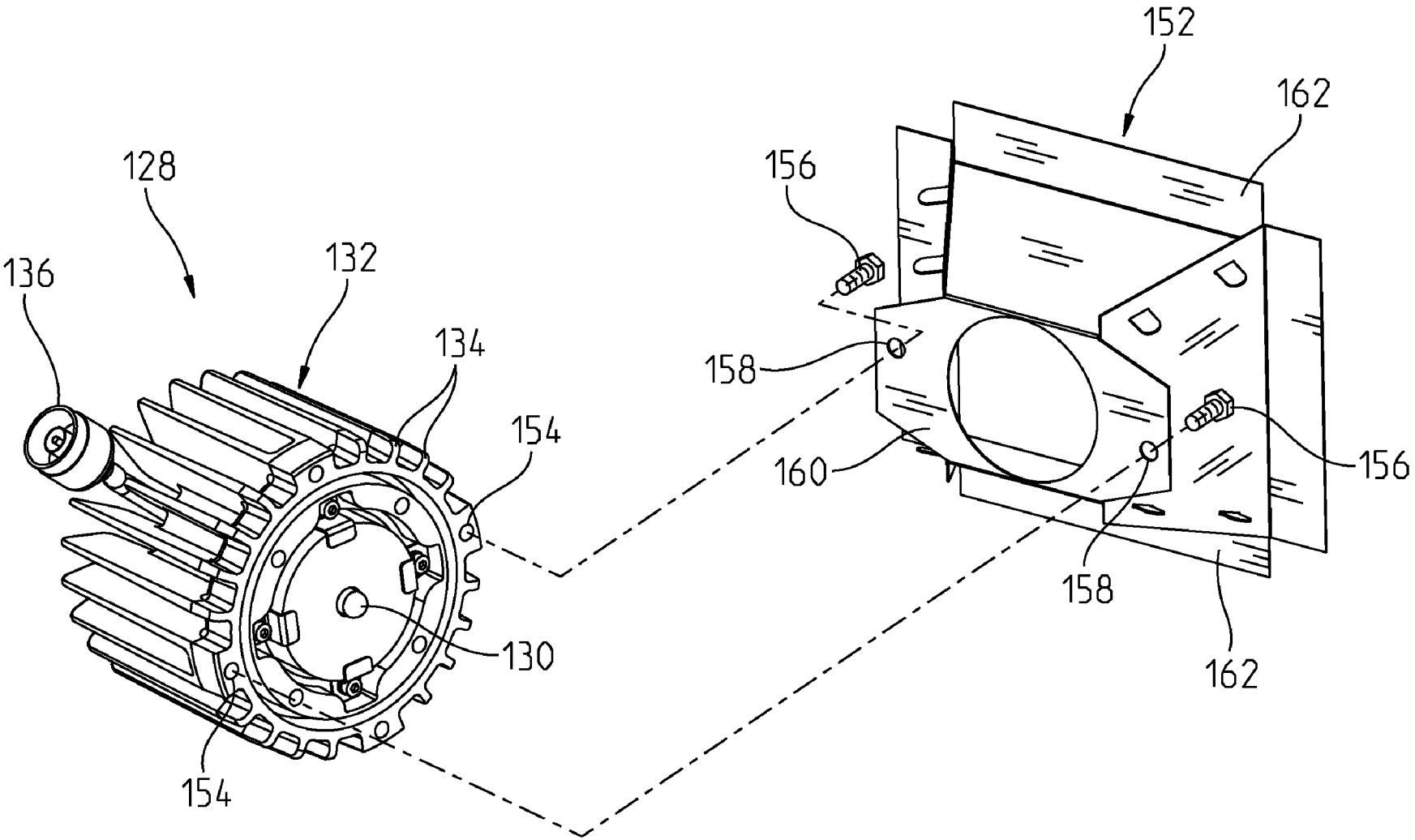
FIGS. 9-11 are exploded perspective views illustrating additional details of mounting components located within the light assembly of FIGS. 2-8.
Figure 10:
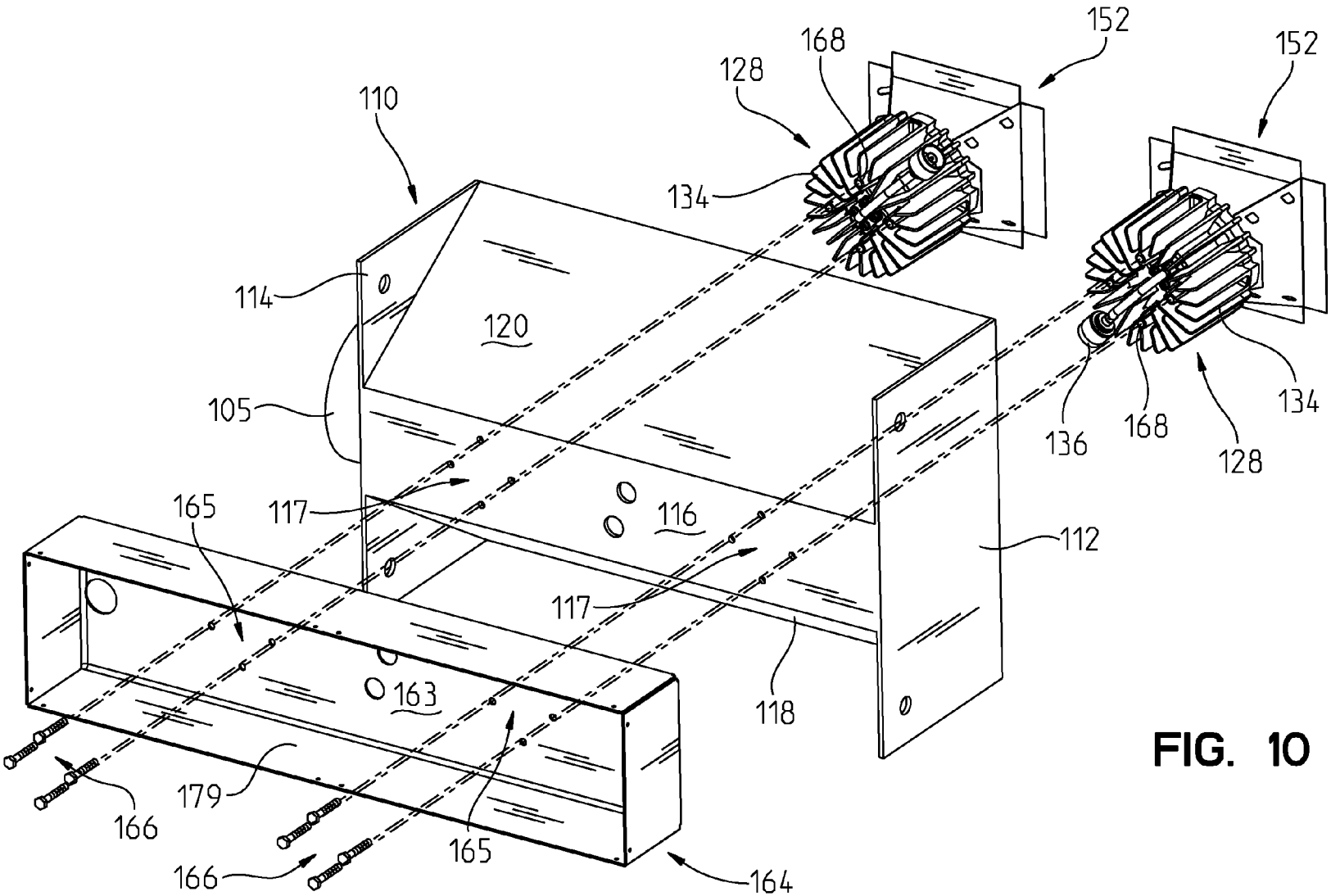
Figure 11:
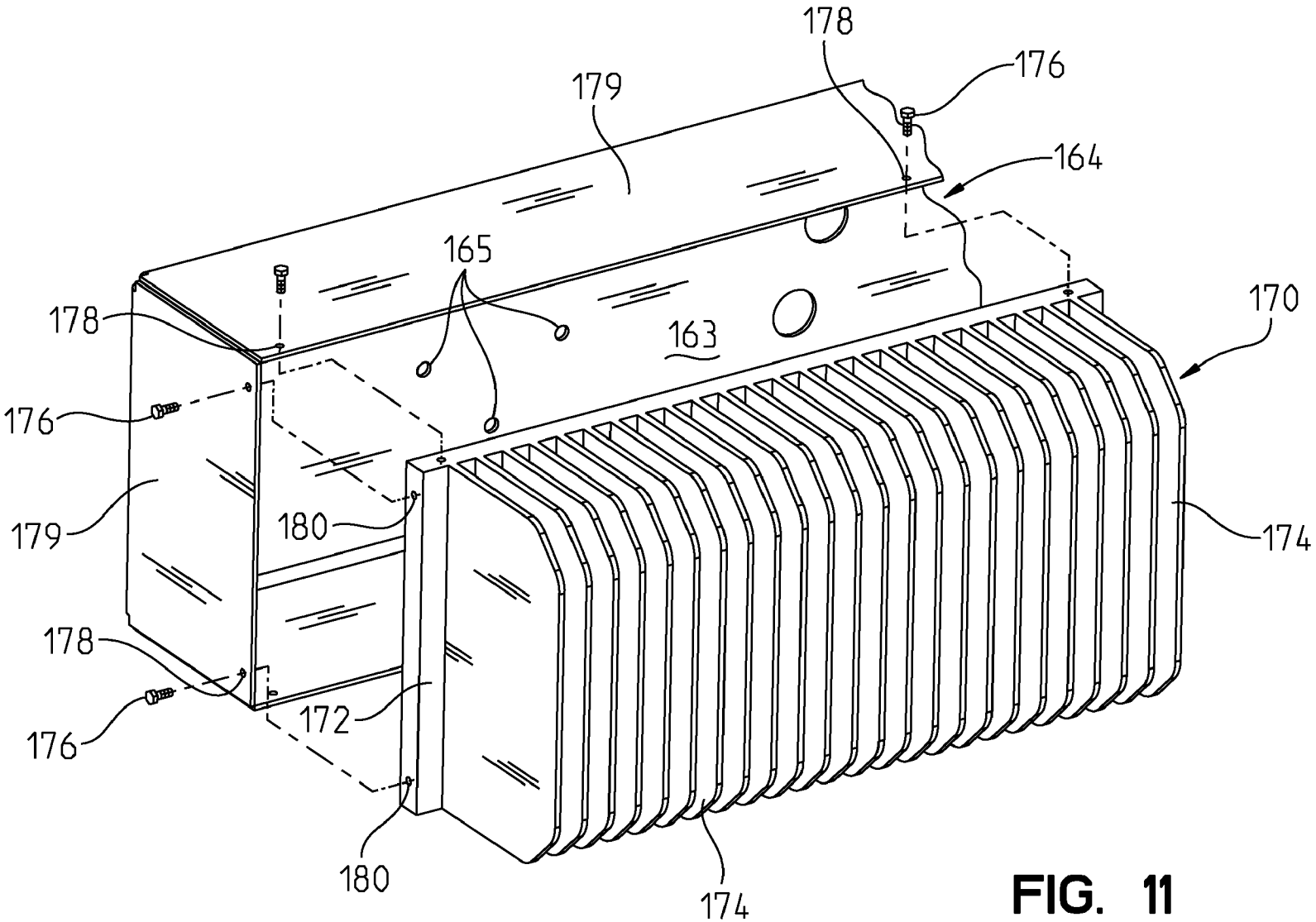

FIG. 8 also illustrates the coaxial cable 137 extending between the connector 136 on emitter 128 and the connector 140 on driver 138. Drivers 138 are mounted to heat sink blocks 170, illustratively by four fasteners extending through apertures 171 in the drivers 138 and into a body portion 172 of heat sink blocks 170 as shown by dotted lines 175 of FIG. 3, for example. The heat sink blocks 170 include a plurality of heat sinking fins 174 extending away from the body portion 172 to dissipate heat generated by the drivers 138 during operation of the lights 40. Each heat sink block 170 is coupled to the driver mounting portion 164 by fasteners 176 which extend through apertures 178 formed in a side wall 179 of driver mounting portion 164 and into threaded apertures 180 formed in body portion 172 of the heat sink block 170.

The driver mounting portion 164 is preferably made from thin-walled sheet metal. Mounting the surface 163 of driver mounting portion 164 against rear wall 116 of housing decreases convective heat transfer from the housing 110 to the driver 138. As shown in FIG. 8, the driver 138 is mounted within an interior region 165 of driver mounting portion 164. A front-facing surface 167 of driver 138 is spaced apart from mounting surface 163 to define an air gap 169 therebetween. The air gap 169 is illustrated by dimension 181 in FIG. 8. In an illustrated embodiment, the dimension of the air gap is less than about 4 cm. In a preferred embodiment, the air gap dimension 181 is less than 2 cm.

The compact design of the lighting apparatus of the present disclosure permits the front facing surface 167 of driver 138 to be mounted in a compact relationship to a rear surface 173 of emitter body 132. As shown in FIG. 8 an air gap 185 is provided between the rear surface 173 of body portion 132 and the rear wall 116. Therefore, a dimension between the front surface 167 of driver 138 and rear surface 173 of body portion 132 is illustrated by dimension 187. Illustratively, the dimension 187 is less than about five inches to provide a compact light design. In a preferred embodiment, the dimension 177 is between about 1 inch and about 3 inches.

The dimensions of air gaps 169 and 185 may be adjusted depending upon the particular light emitter 128 and driver 138 specifications. The heat sink 170 is sized and configured to maintain a temperature of the driver 138 at less than 75° C. Driver 138 has an internal temperature sensor which is monitored by a system controller. Depending upon the maximum ambient temperature that the light 40 is designed to operate in, the designed size of the heat sink 170 may be adjusted during the manufacturing process to maintain effective cooling. Therefore, the configuration of housing 110 and driver mounting portion 164 along with heat sink 170 provide an energy efficient lighting apparatus having a compact design with effective heat management characteristics.

Figure 4:
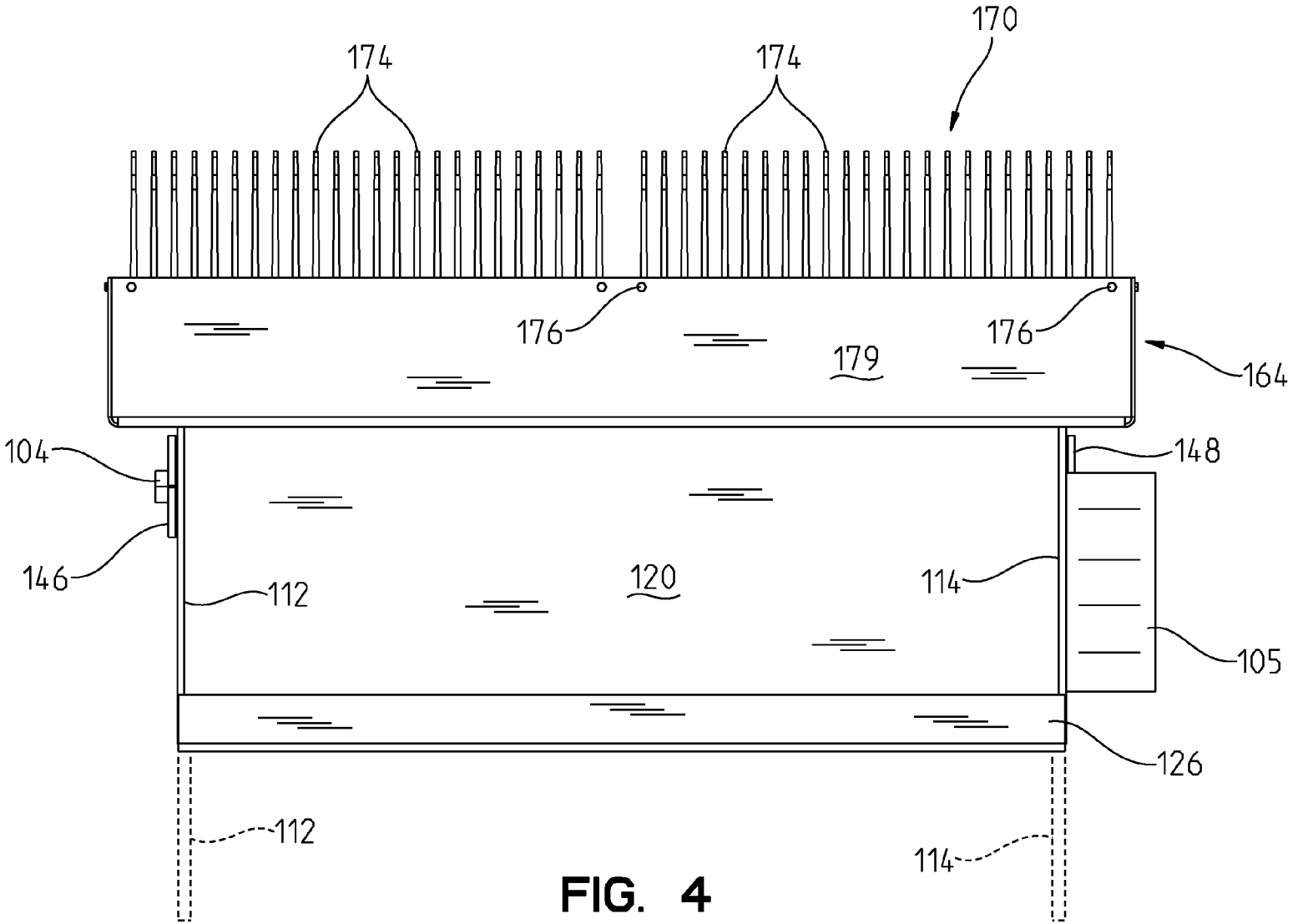
FIG. 4 is a top view of the light of FIGS. 2 and 3.
Figure 5:
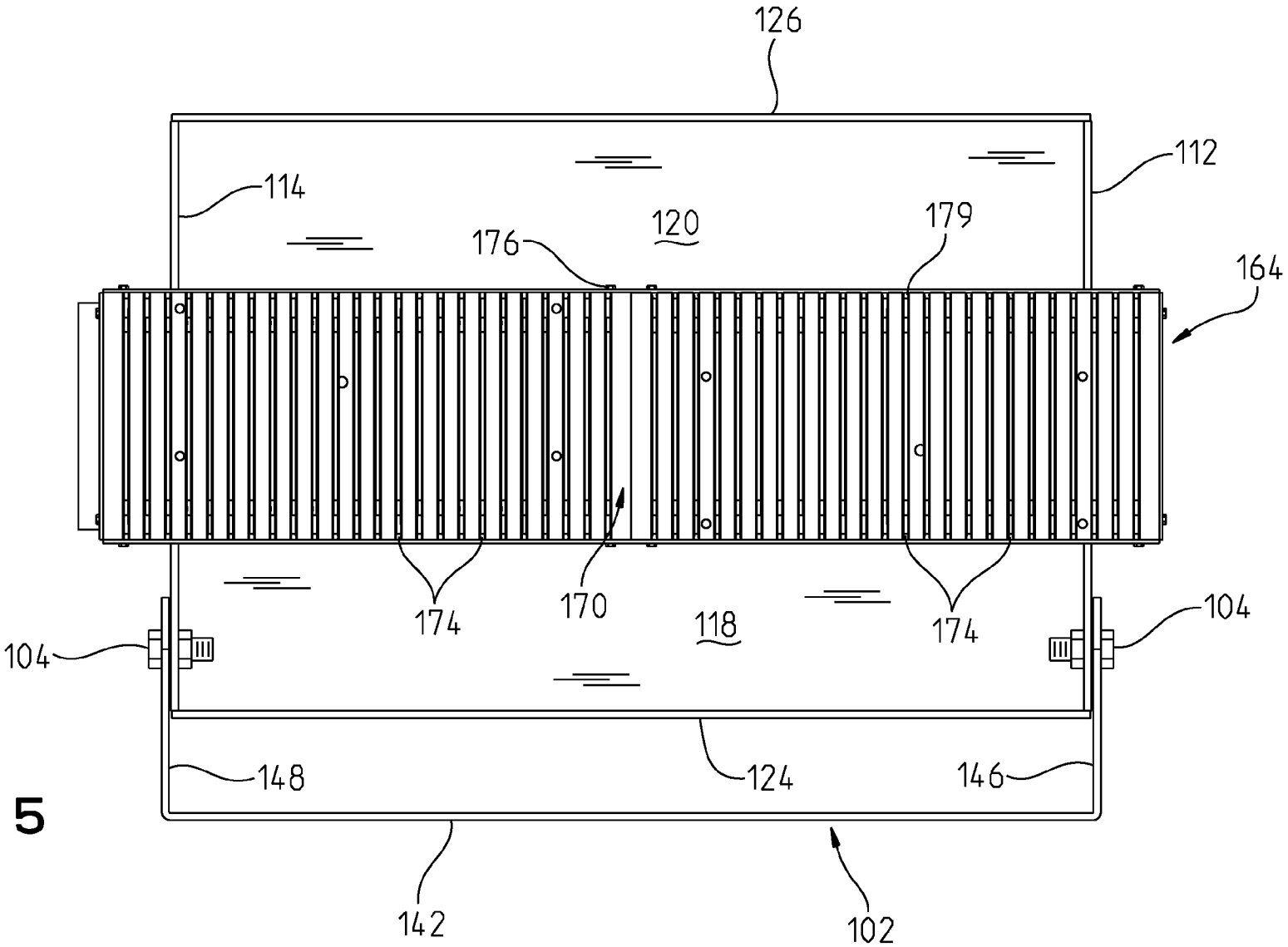
FIG. 5 is a rear view of the light of FIGS. 2-4.
Figure 6:
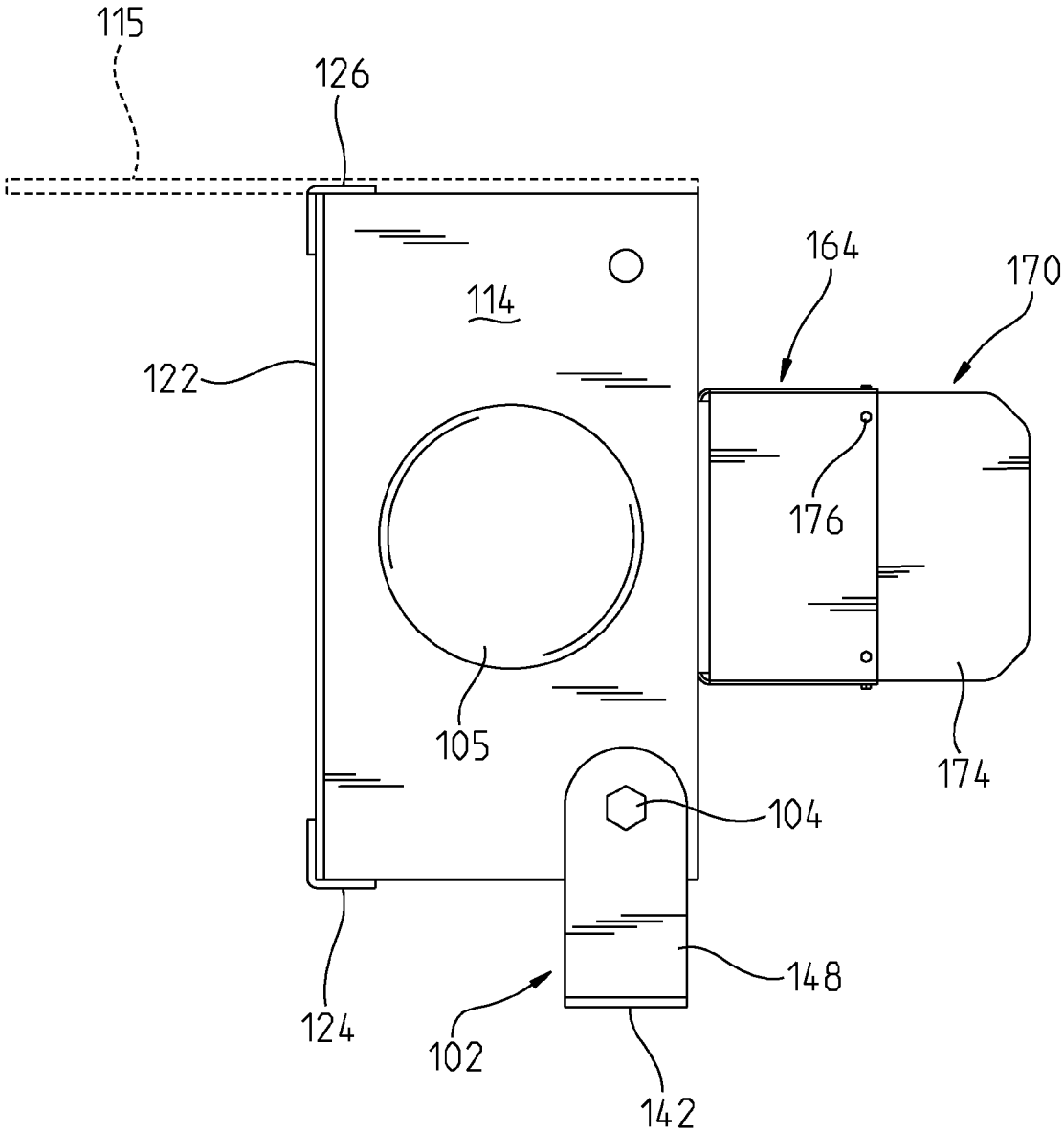
FIG. 6 is a side elevational view of the light of FIGS. 2-5.
Figure 7:
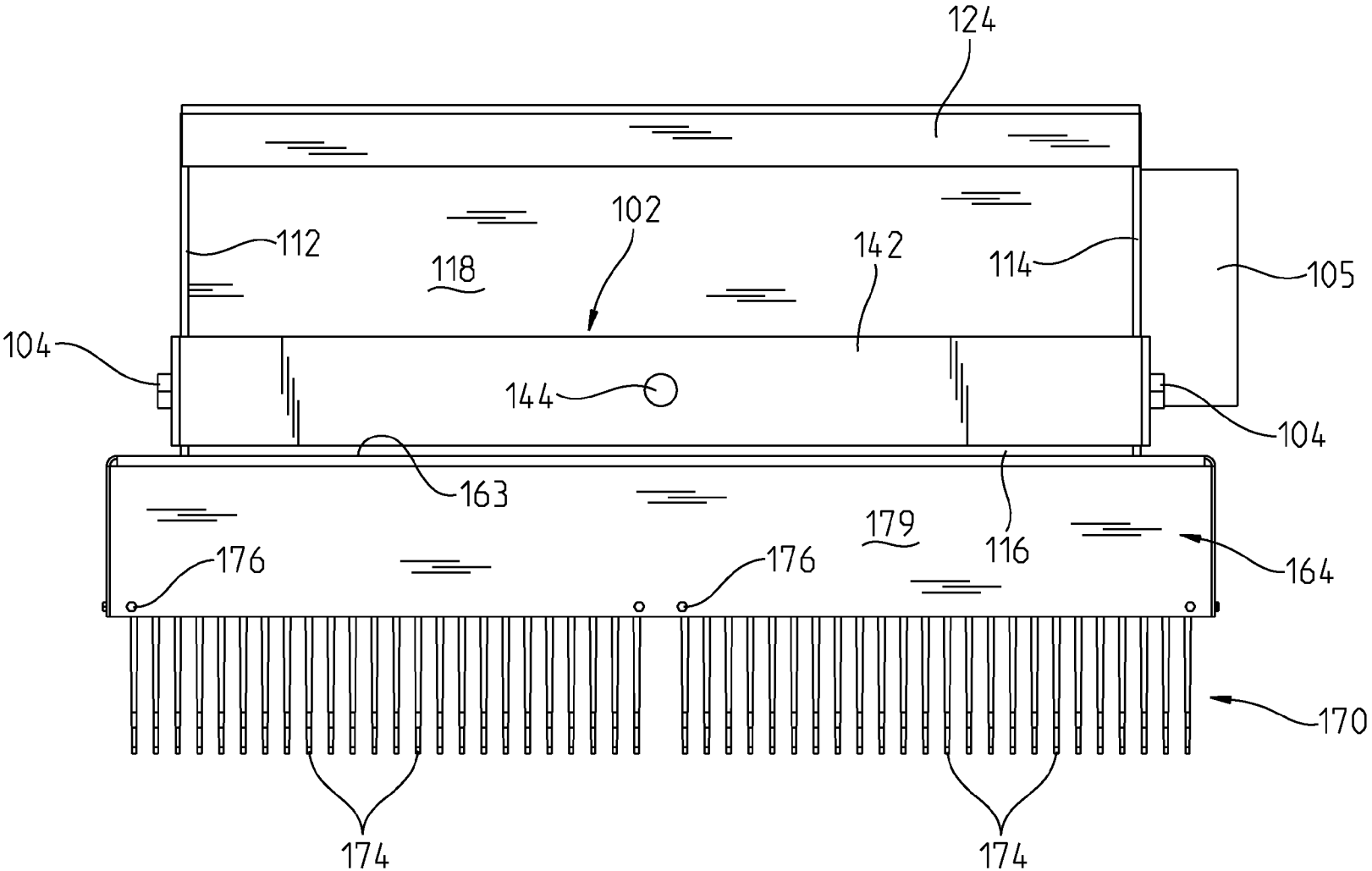
FIG. 7 is a bottom view of the light of FIGS. 2-6.

In certain applications, the side panels 112 and 114 of housing 110 may be extended such as shown, for example, in FIG. 4 for glare control. The extended side panels 112 and 114 act as light baffles to provide glare control for the portable lights 40 when needed, such as when the lights 40 are used for road work. A top baffle 115 may also be added, if necessary, as illustrated in FIG. 6. Top baffle 115 may be helpful to reduce glare when the lights 40 are used next to a building or overpass, for example.

Figure 12:
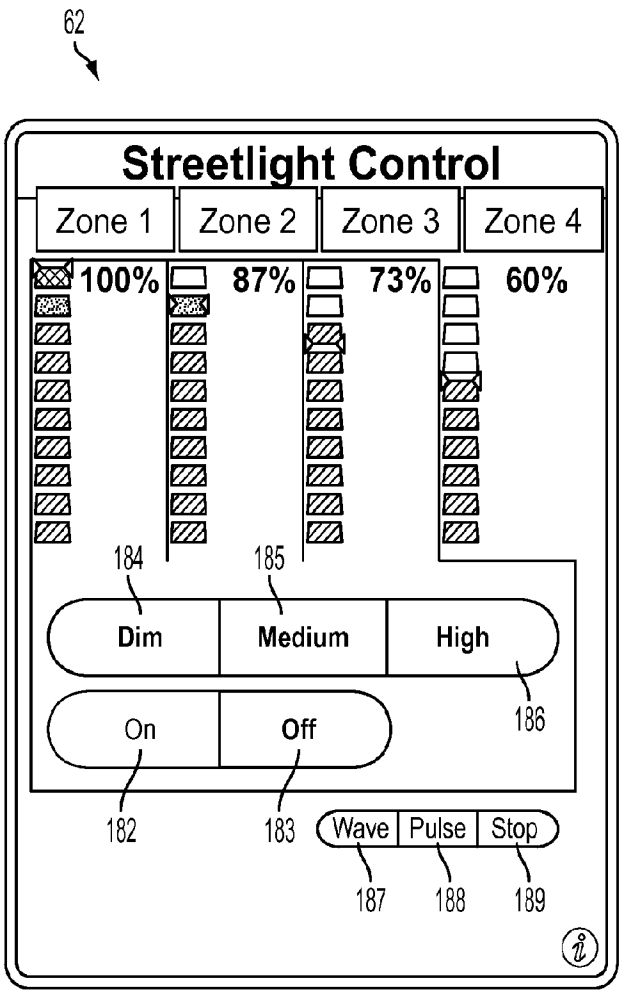

A graphical user interface 62 is provided to control and monitor the lights 40. The user interface 62 may be provided on a remote computing device such as a laptop computer, phone, PDA, or other suitable device. In an illustrated embodiment shown in FIGS. 12 and 13, an illustrative I-phone application is shown. In the illustrated embodiment, each zone controls one of the lights 40 shown in FIG. 1. The operator can turn each individual light 40 on and off by selecting input buttons 182 or 183, respectively. The operator can also control the intensity of each light zone using the "dim", "medium", and "high" buttons 184, 185 and 186, respectively. The graphical user interface 62 illustratively displays the percentage of intensity of each of the zones and provides a graphical display representing the intensity. The operator may also select the "wave", "pulse", and "stop" buttons 187, 188 and 189. Buttons 187, 188, and 189 allow the user to start and stop a program which controls the lights over a predetermined time interval. The wave button 187 controls the lights individually. The pulse button 188 synchronously controls all lights in the array.

Figure 13:
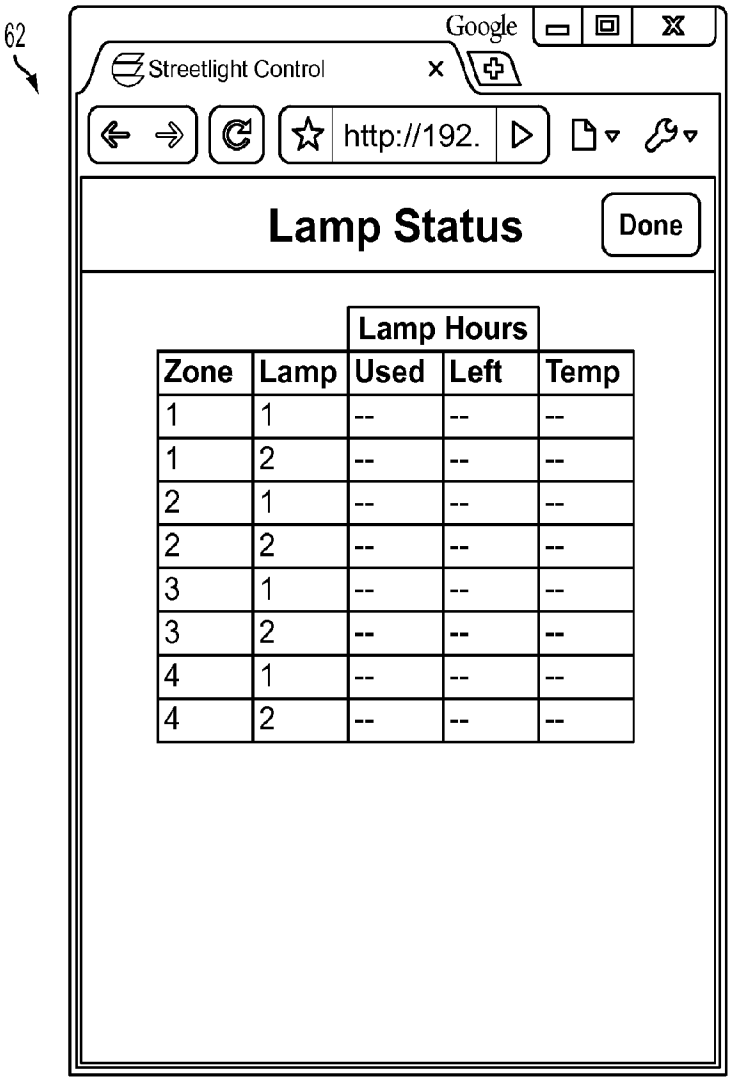
FIGS. 12 and 13 illustrate a graphical user interface used to control and monitor the lights.

FIG. 13 illustrates a lamp status display screen provided on the user interface 62, such as for example, the display screen of an I-phone in the I-phone application. In the illustrated embodiment, each zone includes one light 40 having two lamps or bulbs 130. For each zone, the status of each lamp is provided. For example, the number of lamp hours used and the number of lamp hours remaining are displayed for monitoring by the operator. In addition, a temperature of each lamp is also monitored and displayed.

In another embodiment of the present invention, particularly useful in the film or television industry, color may be added to the lights 40. For example, color slides may be mounted in a receiver 190 located in front of window 122 as shown diagrammatically in FIG. 8. In an alternative embodiment, colored gels are injected into a receiver 190 adjacent window 122 to provide color for the light. In this embodiment, a chiller is typically provided for the gel. The chiller and gel dispenser may be powered by the fuel cell 50 to provide a portable, self-contained, light coloring system. Dichroic filters may also be used when rigid color requirements are necessary. In an illustrated embodiment of the light tower which uses LEDs as the light source, the LEDs may be RGB color tunable diodes.

As discussed above, in the illustrated embodiment, the lights 40 are energy efficient lights such as the plasma lighting discussed above. Features of the plasma lighting include:

High efficiency—120 lumens/watt;
50,000 hour lifetime;
Color rendering up to 96 CRI;
Second turn-on, dimmable to 20%;
Rapid re-strike;
Compact source (¼"×¼");
No audible noise or flicker;
Programmable;
Indoor and outdoor use.

In other embodiments of the present invention, other types of energy efficient lights 40 may be used. For example, lights 40 may include an array of LEDs arranged on lighting panels. The lighting panels may be louvered panels to provide adjustability and improve aerodynamics when the light panels are used on a portable trailer. Louvers and baffling may also be used in order to decrease glare from the view of any person located outside the illuminated area. This may be particularly important for roadside construction lighting projects.

Figure 14:
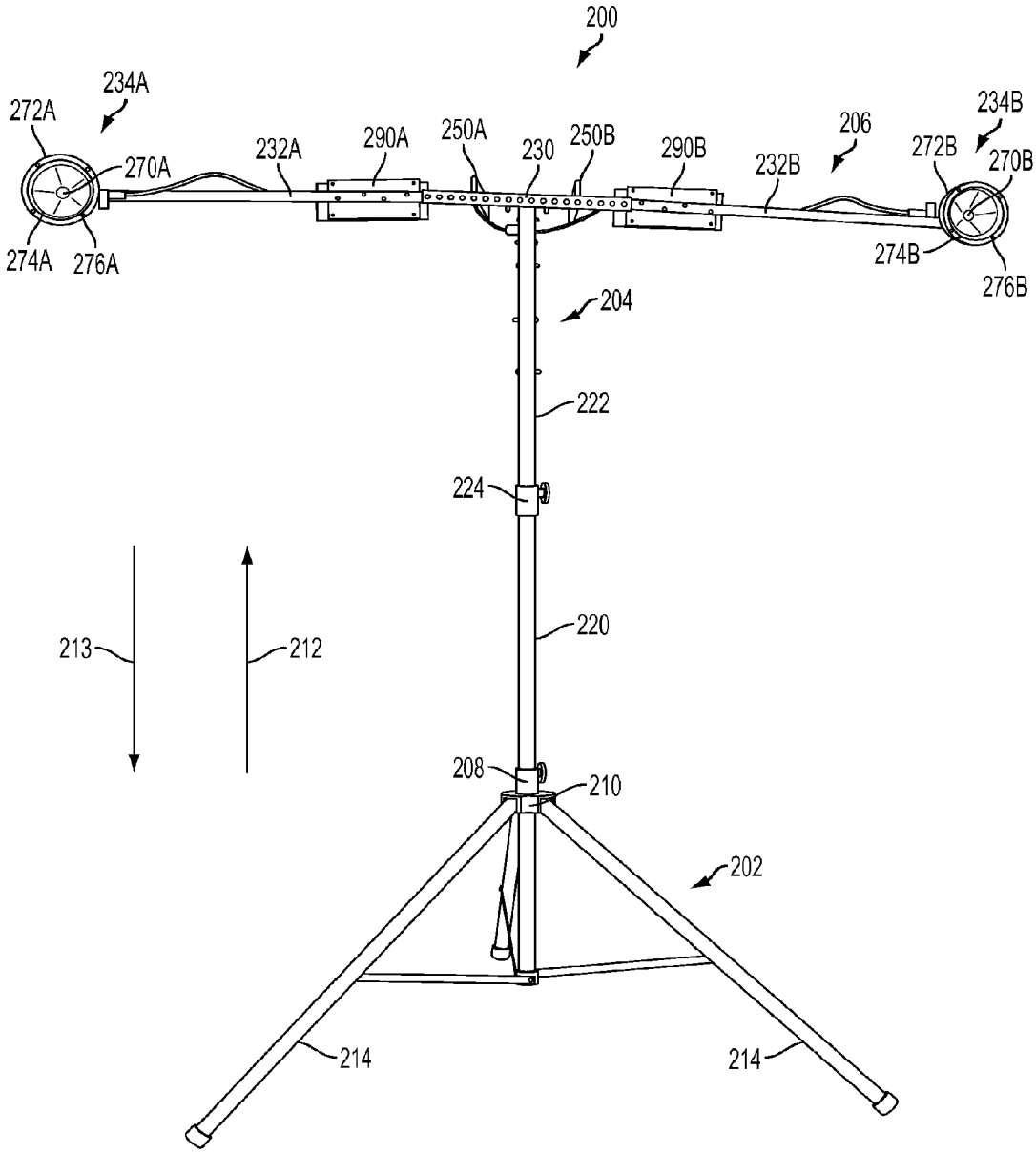
FIG. 14 is a front view of an exemplary portable light device.

Referring to FIG. 14, another embodiment of a portable light device 200 is shown. Portable light device 200 includes a base 202, an adjustable vertical member 204, and a light unit supporting member 206. Adjustable vertical member 204 is supported by base 202. Light unit supporting member 206 is supported by vertical member 204 and is angled relative thereto. Base member 202 is illustrated as a tripod base, but may be any suitable base that provides a stable support for vertical member 204 and light unit supporting member 206. In a preferred embodiment, base member 202 (such as the illustrated tripod base) is collapsible for ease of storage. In the illustrated embodiment, the tripod base is secured in the use position (shown in FIG. 14) by tightening a knurled knob 208 which engages vertical member 204. When knurled knob 208 is loosened, a top portion 210 of the tripod base is able to move in direction 212 which results in legs 214 being positioned generally parallel to and adjacent vertical member 204.

Vertical member 204 includes a lower member 220 and an upper member 222. In the illustrated embodiment both lower member 220 and upper member 222 are of a tubular construction and upper member 222 is received into lower member 220 to provide a telescopic adjustment of a height of portable light device 200 in directions 212 and 213. In one embodiment, the height of portable light device 200 is adjustable from about 5.5 feet to about 10 feet. A knurled knob 224 is coupled to lower member 222 and is threaded into a hole therein to engage an exterior of upper member 222. When knurled knob 224 is loosened upper member 222 is able to be moved relative to lower member 220 to adjust a height of portable light device 200. In one embodiment, a height of portable light device is lowered to place portable light device 200 in a storage configuration.

Figure 20:
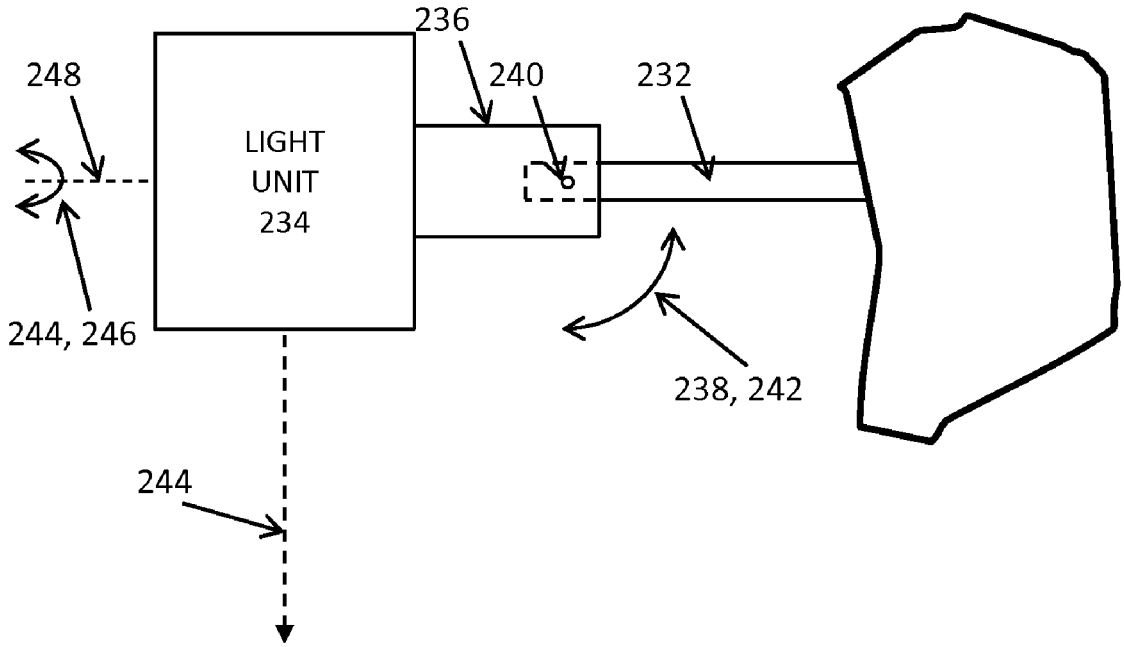
FIG. 20 is a representative view of portions of the exemplary portable light device of FIG. 14.

Light unit supporting member 206 includes a central member 230 which is coupled to upper member 224 of vertical member 204. Light unit supporting member 206 further includes a first light supporting arm 232A and a second light supporting arm 232B which support a first light unit 234A and a second light unit 234B, respectively. Referring to FIG. 20, each of light units 234A, B is pivotally mounted to its respective arm 232A, B and pivots about an axis 240. As shown in FIG. 20, the light unit is supported by a base 236 which is pivotally mounted to the arm 232A, B. In one embodiment, a set screw is provided to unlock the orientation of light unit 234A, B in directions 238, 242 relative to arm 232A, B. This adjustability allows light unit 234A, B to be directed inward towards vertical member 204 or outwards away from vertical member 204. In one embodiment, light unit 234A, B is positioned such that the light is centered generally in a direction 244 which is normal to arm 232A, B.

Base 236 also provides adjustability of light unit 234A, B in directions 244, 246 which means light unit 234A, B may pivot about an axis 248 that is parallel to a longitudinal axis of arm 232A, B. In one embodiment, a set screw is provided to unlock the orientation of light unit 234 A, B in directions 244, 246 relative to arm 232A, B. This adjustability allows light unit 234A, B to be directed downward towards base 202 or upwards away from base 202.

Figure 15:
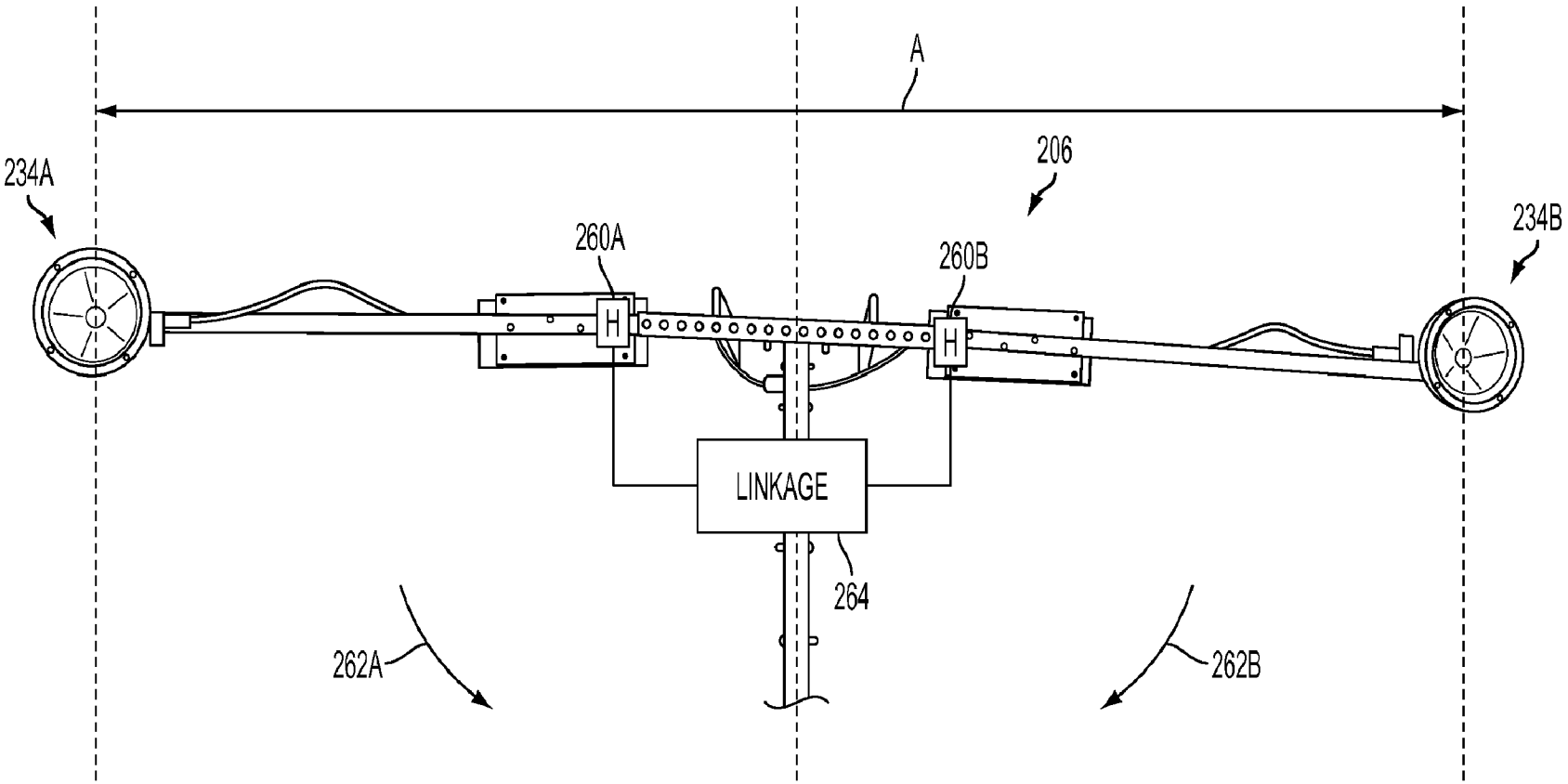
FIG. 15 illustrates another exemplary embodiment of a portion of a portable light device.

Returning to FIG. 14, each of arms 232A, B are coupled to central member 230 by a pin member 250 A, B which is received in apertures in central member 230 and in the respective arms 232A, B. In the illustrated embodiment, central member 230 includes a plurality of spaced apart apertures to provide some adjustability of an overall width of light unit supporting member 206 and light units 234A, B. Referring to FIG. 15, a width A of light unit supporting member 206 and light units 234A, B (from source to source) is about 7 feet, four inches with an adjustment of about 2 inches in each arm 232A, B in either direction. When A is equal to about 7 feet, 4 inches then the overall width of light unit supporting member 206 and light units 234 A, B is about 8 feet, 1 inch.

Pin members 250A, B permit arms 232A, B to be uncovered from central member 230. This further reduces the overall size of portable light unit 200. In one embodiment, with base member 202 placed in a storage position, vertical member adjusted to its lowest height, and arms 232A, B removed from central member 230, all of portable light device will fit within a storage unit having a cylindrical shape with a diameter of about 10 inches and a length of about 5 feet, 2 inches.

Arms 232A and 232B are coupled to central member 230 through hinge members 260A and 260 B, respectively, shown in FIG. 15 which permit arms 232A and 232B to rotate downward in directions 262A and 262B, respectively. In one embodiment, a pin member or other coupler holds the respective arms 232A, B in the use position shown in FIG. 15. In one embodiment, a linkage 264 is coupled to each of arms 232A, B and is supported by vertical member 204. The linkage may move relative to vertical member 204 in directions 212 (to raise arms 232A, B) and 213 (to lower arms 232A, B). As such, arms 232A, B may be lowered or raised in a coordinated motion. In one embodiment, linkage 264 includes a ring that surrounds vertical member 204 and is coupled to vertical member 204 through a knurled knob to lock the position of arms 232A, B relative to vertical member 204.

Referring to FIG. 14, each of light units 234A, B include a light source 270A, B, a reflector 272A, B, a window 274A, B, and a housing 276A, B. In one embodiment, the light sources are a high intensity solid state light source. An exemplary light source is the LIFI STA-40 Series brand light source available from Luxim located at 1171 Borregas Avenue in Sunnyvale, Calif. 94089.

In one embodiment, reflectors 272A, B are conical in shape. In one embodiment, the light sources centered on an axis of the cone of the reflector, the reflector being a straight cone. In one embodiment, the cone has a diameter of about 10 mm adjacent the light source. In one embodiment, reflector 272A, B produces illumination extent of about 120 degrees having a uniformity of intensity of about 2:1 (maximum intensity in the field of illumination to minimum intensity in the field of illumination). The size of the exit aperture of reflector 270A, B affects the crispness of the illumination field at the edge. The larger the exit aperture the crisper the illumination field is at the edge (quick drop-off in intensity).

In one embodiment, the light source 270A, B is fed by radio-frequency ("RF") energy. Light arms 232A, B support drivers 290A, B which supply RF energy to the respective light sources through coaxial cable (coax). The drivers are supported by the light arms 232A, B closer to vertical member 204 than light sources 270A, B. This increases the stability of light device 200. In one embodiment, drivers 290A, B are connected to light sources 276 A, B through extended coaxial cable (extended coax) which permits drivers 290A, B to be mounted over vertical member 204 to central member 230 or to vertical member 204. Exemplary drivers 290A, B are available from Luxim located at 1171 Borregas Avenue in Sunnyvale, Calif. 94089 which convert direct current (DC) to the RF energy needed to drive light sources 270A, B. The drivers 290A, B shown in FIG. 14 also include heat sinks coupled thereto.

Figure 16:
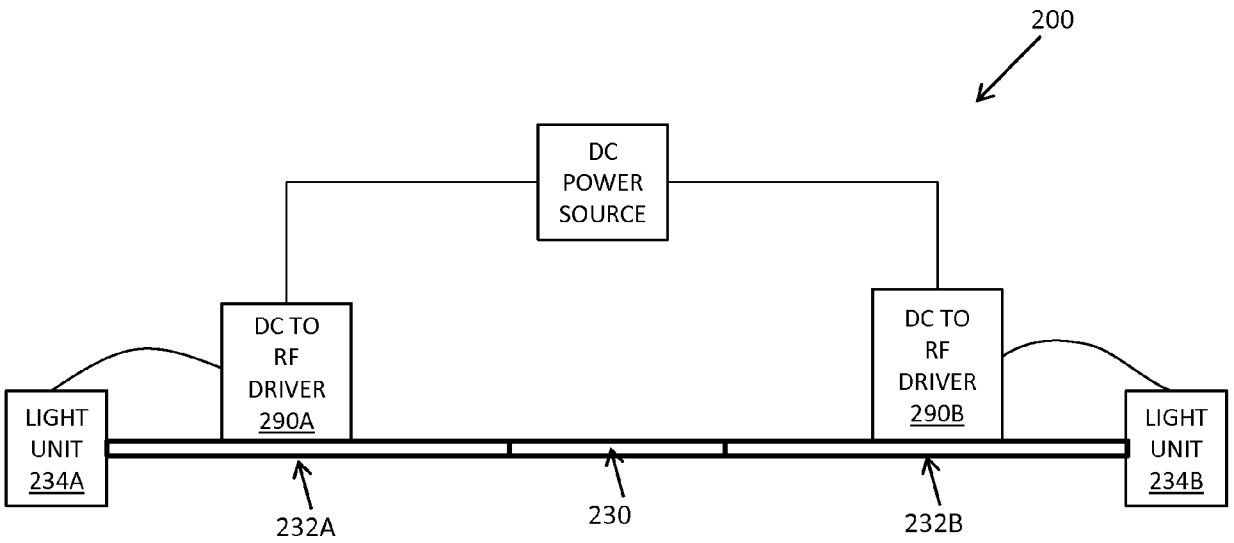
FIG. 16 is a representative top view of portions of the exemplary portable light device of FIG. 14.

Referring to FIG. 16, a representative view of the setup of FIG. 15 is shown. The drivers 290A, B are coupled to a DC power source 292. Each light unit 234A, B has its own driver 290A, B.

Figure 17:
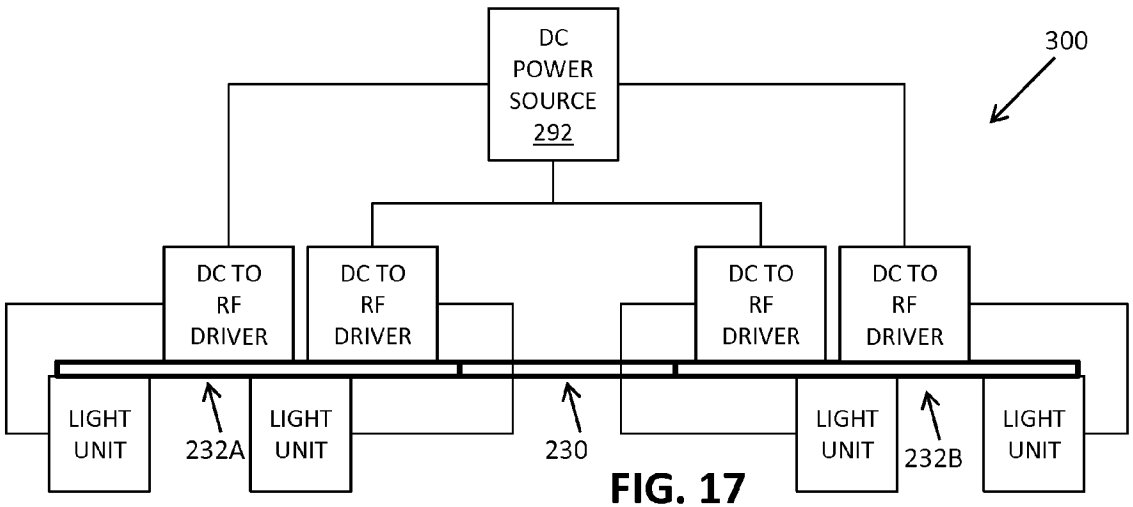
FIG. 17 is a representative top view of another embodiment of an exemplary portable light device.

Referring to FIG. 17, a representative view of another embodiment 300 is shown wherein additional light units are attached to arms 232A, B. These additional light units also have their own drivers which are coupled to DC power source 292. All of the light units may be arranged in a straight row or staggered. In one embodiment an additional light supporting arm is provided in two light units and respective drivers are supported by each light supporting arm.

Figure 18:
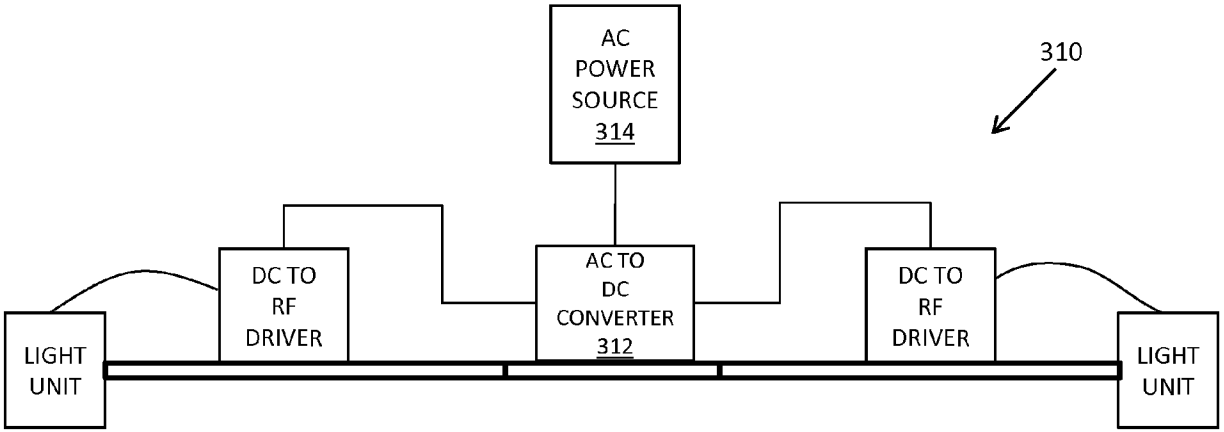
FIG. 18 is a representative top view of still another embodiment of an exemplary portable light device.

Referring to FIG. 18, a representative view of another embodiment 310 is shown wherein and alternating current (AC) to DC converter 312 is provided. Converter 312 is coupled to drivers to supply DC current to the drivers. Converter 312 is also coupled to an AC power source 314, such as a wall outlet.

Figure 19:
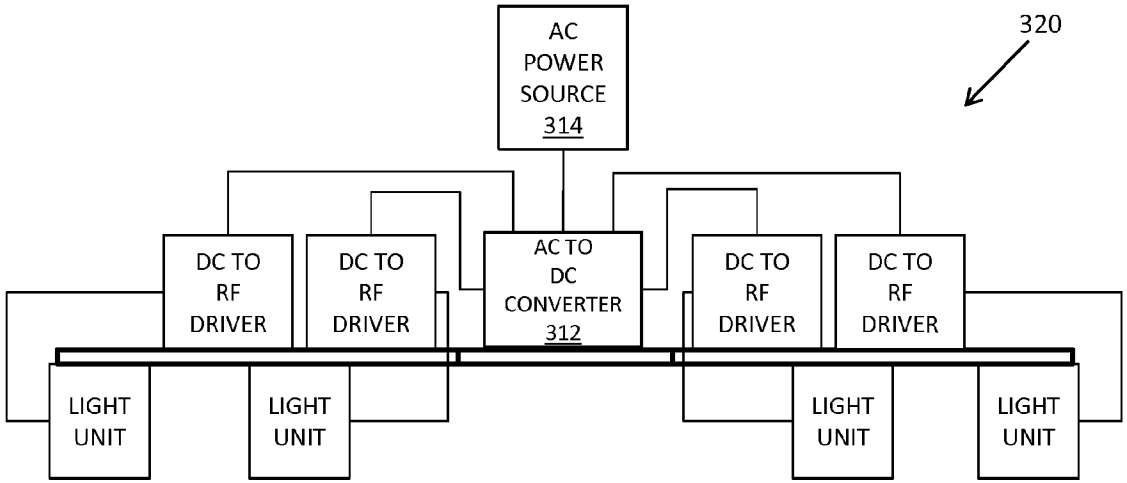
FIG. 19 is a representative top view of yet another embodiment of an exemplary portable light device.

Referring to FIG. 19, a representative view of another embodiment 320 is shown wherein additional light units are attached to arms 232A, B. These additional light units also have their own drivers which are coupled to converter 312. All of the light units may be arranged in a straight row or staggered. In one embodiment an additional light supporting arm is provided in two light units and respective drivers are supported by each light supporting arm.

In one embodiment, portable light device 200 with two light units 234A, B produces the equivalent of about 1 kW of power and with four light units 234A, B the equivalent of about 2 kW of power.

While this disclosure has been described as having exemplary designs and embodiments, the present system may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

The invention claimed is:

1. A lighting apparatus comprising:

a housing including a rear wall, first and second side panels, a top wall, a bottom wall and a front window cooperating to define an interior region of the housing;

a light emitter located in the interior region of the housing;

a driver for the emitter;

a heat sink coupled to the driver, the heat sink including a plurality of fins for cooling the driver; and a driver mounting portion having a mounting surface and a side wall, the side wall being coupled to one of the heat sink and the driver so that the plurality of fins of the heat sink are exposed, and wherein the mounting surface of the driver mounting portion is coupled to the housing.

2. The apparatus of claim 1, wherein the driver mounting portion is formed from sheet metal.

3. The apparatus of claim 1, wherein the mounting surface and side wall of the driver mounting portion and the heat sink define an interior region of the driver mounting portion, the driver being located in the interior region.

4. The apparatus of claim 3, wherein the driver is spaced apart from the mounting surface of the driver mounting portion to provide an air gap to reduce heat transfer from the housing containing the light emitter to the driver.

5. The apparatus of claim 4, wherein the air gap is less than 4 cm.

6. The apparatus of claim 4, wherein the air gap is less than 2 cm.

7. The apparatus of claim 1, wherein the light emitter includes a body portion and a bulb located on a front side of the body portion, the driver being positioned in the driver mounting portion so that a front surface of the driver is spaced apart from a rear surface of the body portion of the emitter by a dimension of less than 5 inches.

8. The apparatus of claim 7, wherein the dimension is about 1-3 inches.

9. The apparatus of claim 7, wherein the heat sink is configured to maintain a temperature of the driver at less than or equal to 75° C.

10. The apparatus of claim 1, wherein the heat sink includes a body portion having a first side coupled to the driver, the plurality of fins being configured to extend away from a second, opposite side of the body portion of the heat sink, and wherein the side wall of the driver mounting portion is coupled to the body portion of the heat sink.

11. The apparatus of claim 1, wherein the mounting surface of the driver mounting portion is coupled to the rear wall of the housing.

12. The apparatus of claim 1, wherein the top and bottom walls of the housing are aligned at opposing angles so that the interior region of the housing is divergent in a direction extending from the rear wall of the housing to a front edge of the housing adjacent the front window.

13. The apparatus of claim 1, further comprising a mounting bracket coupled to the housing.

14. The apparatus of claim 13, wherein the mounting bracket permits the housing to rotate about a first axis and a second axis, the second axis being transverse to the first axis.

15. The apparatus of claim 1, wherein the light emitter includes a plasma bulb located within a dielectric material, and wherein the driver generates a radio frequency (RF) signal which is guided to the emitter by a cable so that the RF signal vaporizes contents of the bulb into a plasma state to generate a source of light.

16. The apparatus of claim 1, further comprising a reflector located within the interior region of the housing, the reflector being coupled to a front surface of the emitter surrounding a bulb.

17. The apparatus of claim 1, further comprising at least one baffle coupled to at least one of the first and second side panels and the top wall of the housing, the at least one baffle extending beyond the front window to reduce glare from the light emitter.

18. The apparatus of claim 1, wherein the light emitter is coupled to the housing by a plurality of fasteners extending through the mounting surface of the driver mounting portion and through the rear wall of the housing, the fasteners being coupled to a body portion of the emitter.

19. The apparatus of claim 1, further comprising a controller coupled to the driver and a graphical user interface coupled to the controller, the graphical user interface including a display configured to receive user inputs to adjust an intensity of light emitted by the light emitter and to monitor conditions of at least one of the driver and the light emitter from a remote location.

20. The apparatus of claim 19, wherein the graphical user interface displays an indication of an amount of time that the light emitter has been operated, an estimated amount of time left during an operational life of the light emitter, and a temperature of at least one of the driver and the light emitter.

* * * * *